United States Patent [19]

Baus

[11] Patent Number: 4,653,127

[45] Date of Patent: Mar. 31, 1987

[54] SHOWER PARTITION

[76] Inventor: Heinz G. Baus, 35 Wartbodenstrasse, CH-3626 Hünibach-Thun, Switzerland

[21] Appl. No.: 762,386

[22] Filed: Aug. 5, 1985

[30] Foreign Application Priority Data

Aug. 7, 1984 [DE] Fed. Rep. of Germany ..... 3429053

[51] Int. Cl.[4] ..... A47K 3/22

[52] U.S. Cl. ..... 4/610; 4/607; 4/608; 49/409; 49/425

[58] Field of Search ..... 4/607, 608, 610; 49/409, 410, 411, 412, 425

[56] References Cited

U.S. PATENT DOCUMENTS

| | | | |
|---|---|---|---|
| 1,775,827 | 9/1930 | Pacyna et al. | 49/409 |
| 2,754,535 | 7/1956 | Plemeng | 49/411 |
| 2,929,115 | 3/1960 | Beckstrom | 49/411 |
| 2,984,718 | 5/1961 | Fish | 49/409 X |
| 3,074,077 | 1/1963 | Taubman | 4/607 |
| 3,310,914 | 3/1967 | De Klavon | 49/411 |
| 3,425,162 | 2/1969 | Halpern | 49/425 |
| 3,653,157 | 4/1972 | Casebolt | 49/411 |

FOREIGN PATENT DOCUMENTS

| | | | |
|---|---|---|---|
| 2604376 | 8/1977 | Fed. Rep. of Germany | 4/607 |
| 3209768 | 9/1983 | Fed. Rep. of Germany | 4/607 |
| 2170292 | 9/1973 | France | 4/607 |
| 376027 | 7/1932 | United Kingdom | 49/425 |
| 2045847 | 11/1980 | United Kingdom | 4/607 |

*Primary Examiner*—Henry K. Artis

*Attorney, Agent, or Firm*—Schwartz, Jeffery, Schwaab, Mack, Blumenthal & Evans

[57] ABSTRACT

A shower partition with a horizontal guide rail includes a door assembly displaceable in the guide rail by guide roller mounted on eccentric pins. Each eccentric pin is arranged in a hole provided through the upper edge of the door assembly. In the case of a shower partition of this kind, the purpose to be accomplished is to simplify vertical adjustment of the door assembly at low structural cost, and to ensure that the adjusted position is reliably secured. For this purpose each eccentric pin is slid in an elongated slot of the door assembly through an end opening. Also provided is a connector member having arms which bear upon opposite engagement surfaces of the eccentric pin in order to secure the latter against rotation.

15 Claims, 3 Drawing Figures

SHOWER PARTITION

BACKGROUND OF THE INVENTION

1. Field of the Invention

The invention relates to a shower partition comprising a horizontal guide rail with at least one door assembly guided therein through an eccentric pin member, the latter being arranged in a slot provided in the upper edge of the door assembly, and being secured against rotation.

2. Description of the Prior Art

German Offenlegungsschrift No. 32 09 768 discloses a shower partition of which the door elements are displaceable, in a horizontal guide rail, by means of guide rollers. The guide roller is arranged in a mounting which projects, from above, into a profiled rail of the door element. Located at the upper edge of the door element, and of the said profiled rail, is a hole for an eccentric pin which is arranged rotatably upon the retaining element. During assembly, the roller mounting must first be inserted from above into a recess in the profiled rail, after which the said eccentric pin must be connected to the roller mounting. This means a considerable expenditure for assembly. Also necessary are additional precautions to prevent subsequent release of the eccentric pin. Functional prevention of rotation of the eccentric pin arranged in the hole in the door element also raises problems. More particularly, production tolerances and wear in the said pin may produce inadmissible rotation thereof and may alter the vertical adjustment made. The distance between the guide rollers, or the like, arranged on the eccentric pin, and the upper edge of the door element, is adjustable, thus making it possible to alter the vertical adjustment and the vertical alignment of the said door element. Very close tolerances must be maintained during production of the eccentric pin and the hole and this is correspondingly costly. In practice, it would be impossible to prevent inadvertent misplacement with the necessary reliability.

OBJECTS OF THE INVENTION

It is therefore an object of the invention to provide a shower partition of the type mentioned above, at low structural cost, in such a manner as to permit rapid and reliable vertical adjustment of the door element or assembly. It is to be possible to produce the said shower partition rapidly and at low cost, assembly and vertical adjustment being affected without any special tools. Adjusting the door element vertically is to be a simple matter and subsequent inadvertent misplacement is to be avoided. Finally, the eccentric pin member is to be reliably kept in position and to be functionally prevented from rotating in the door assembly.

In order to accomplish this object, it is proposed that the eccentric pin member be arranged in an elongated slot in the door element, being inserted into the elongated slot through an end opening, and that a connector member, having an arm, bear upon an engagement surface of the eccentric pin member, for the purpose of securing it against rotation.

The shower partition according to the invention is of inexpensive design and little expenditure is involved in the means for vertical adjustment of the door element or assembly. Production and assembly are extremely inexpensive, since the pin merely has to be pushed through the end opening into the elongated slot, the connector member being placed with one arm on the engagement surface. There is no difficulty in predetermining the retaining force required to prevent rotation which force is such that, in case of need, vertical adjustment can be effected, without too much effort, by means of a tool or the like. If necessary the eccentric pin member may be rotated about its longitudinal axis, thus overcoming the predetermined retaining force. It is desirable for the retaining force to be determined by preselection of the coefficient of friction and/or the roughness and/or the shape of the engagement surface and of the bearing surface of the resilient engagement element. According to the invention, the retaining force is preselected in such a manner that, on the one hand, independent misplacement cannot occur and, on the other hand, for example, rotation and thus vertical adjustment can be effected by means of a screwdriver or a coin, without too much effort. The retaining force acts in such a manner that the eccentric pin member is not forced out of the slot.

In one particular embodiment, the eccentric pin member is located in the door assembly by means of the connector member which is also used to connect the frame members of the door assembly. The connector member may be in the form of a corner joint for two adjoining frame members, so that connection of the frame members and location of the eccentric pin may be carried out in a single operation. The connector member not only closes the opening through which the pin is inserted, but its arm, and the engagement element thereof, predetermines the aforesaid retaining force. A cylindrical hole may also be provided, the said hole preferably comprising a lateral opening for the insertion of the pin member. The force acts at right angles to the direction of the opening or of the elongated slot, in order to ensure reliable location. The retaining force is substantially independent of the locating force.

In one particular embodiment, the resilient engagement element comprises an arm connected to the door assembly, more particularly a locking arm. The said arm is made of a resilient spring material. Accordingly, the retaining force may be selected in the desired manner by the length of the arm and/or by choice of the material of which it is made. Particularly favourable is the arrangement of two locking arms as far as possible diametrically opposite each other, the said arms surrounding the eccentric pin member and the teeth thereof. In this case, specially close tolerances are not needed, especially since the said locking arms engage in the teeth with a preselectable initial stress; in this instance, the flow of force passes, over an extremely short distance, through the two locking arms connected directly to each other. The teeth are arranged coaxially with the axis of rotation of the eccentric pin or with the axis of the slot, so that the same retaining force will always be applied by the eccentric pin member, regardless of its rotational position.

In another embodiment, the eccentric pin is arranged in an elongated slot into which it may be inserted through an end opening. This makes assembly particularly simple, since the eccentric pin, and the guide rollers arranged thereon, may be inserted with one hand into the elongated slot, from the side. In this connection, the weight of the door assembly may be taken by the eccentric pin directly through the substantially horizontal edge of the elongated slot. The eccentric pin, and thus the guide roller, are locked in the door element by means of the locking arm and the connector member, as explained hereinafter.

Preferably, the locking arm, or arms, are arranged on a connector member of the door assembly by means of an attachment element. The connector member is in the form of a corner joint by means of which two adjoining door frame members are joined together. It also serves to secure the eccentric pin in the abovementioned elongated slot. In effect, the locking arm covers the elongated slot at least partly, and release of the eccentric pin from the elongated slot is prevented at extremely low cost. Assembly requires little time, since the eccentric pin, with the guide roller, need merely be pushed from the side, through the open end into the elongated slot, after which the connecting part is inserted and secured.

Preferably also, the connector member comprises a pin engaging in a longitudinal channel in the top profiled rail, the said channel containing a web with projections, and a threaded channel being formed, for the attachment element, between the said web and its projections and the said pin. The connection between the connector member and the profiled rail is effected at a low production cost, while still ensuring a stable and reliable connection. This proposed connector member may be used for the joint between two frame member profiled rails, for any desired applications, in which case only a single attachment element is needed. The profiled rail side member comprises a transverse passage, in alignment with the pin, for the attachment element, the latter engaging in the longitudinal channel in the top profiled rail in the manner explained. The connector member proposed serves as a corner joint for two profiled rail frame members preferably arranged at right angles to each other. According to the statements made hereinbefore, the same connector member also serves to secure the eccentric pin, together with the guide roller, in the elongated slot in the profiled rail top frame member.

In order to obtain a stable connection, using a small amount of material and simple production methods, the pin and the connector member comprise a support element engaging behind the said projections on the web in the longitudinal channel. Undue bending of the projections and the web is prevented in a surprisingly simple manner. The support element is arranged between the said projections and a lateral inner wall of the longitudinal channel, and any bending of the web or the projections is reliably avoided. If the attachment element is in the form of a screw, the threads thereof engage both in the pin and in the projections and the web, although the latter is reliably supported by the proposed support element. This, therefore, produces a stable connection between two frame members, and the threaded channel can be produced so that it weighs little and uses little material. The attachment element is preferably engaged by the projections over an angular range of about 180°, an adequate attachment surface being provided. If the frame member profiled rails are in the form of clamping rails, the spring action is not impaired by the arrangement of the web and projections on the inner lateral wall of one arm and the engagement behind.

SUMMARY OF THE INVENTION

Accordingly, the invention is a shower partition having a horizontal guide rail and at least one door assembly which is mounted for displacement along the guide rail. The door assembly comprises a top frame member, side frame members and connector members joining the side frame members to the top frame member, the top frame member being formed with an upwardly projecting guide member which has a horizontal open-ended slot at each end thereof. A pair of solid eccentric pin members are mounted on the aforesaid guide member, each pin member comprising: a circular rotary central part slid inside one of the slots through its open end; a circular outer part coaxial with the central part and projecting outwardly on one side of the guide member and a cylindrical stub shaft having an axis which is eccentric with respect to the common axis of the coaxial central and outer parts and which project outwardly on the other side of the guide member. Means are provided on the connector members for resiliently holding the circular outer parts, and thus the eccentric pin members, against rotation in the slots. A pair of guide rollers are mounted on the guide rail so as to allow displacement of the door assembly and, for that purpose, means mount the rollers each on one of the eccentric stub shafts so as to allow their rotation about the aforesaid eccentric axes.

BRIEF DESCRIPTION OF THE DRAWINGS

Other features and advantages of the invention will become apparent from the following description of a preferred embodiment in conjunction with the accompanying drawings, wherein:

FIG. 1 illustrates one upper corner of a door assembly 2 partly in elevation and partly in cross-section. Part of a top frame member profiled rail 4, and of a side frame member profiled rail 6, of the door assembly may be seen, the said rails being joined together by a connector member 8 and an attachment element 10 which is in the form of a screw. Door assembly 2 contains two more profiled rails which are united with the said profiled rails 4 and 6, and with each other, to form a rectangular frame, the corner joints being designed accordingly. Profiled rails 4, 6 and the additional rails mentioned above, are in the form of clamping profiles and accommodate a sheet 12 of transparent material or the like, as shown in FIG. 2.

Figure 1:
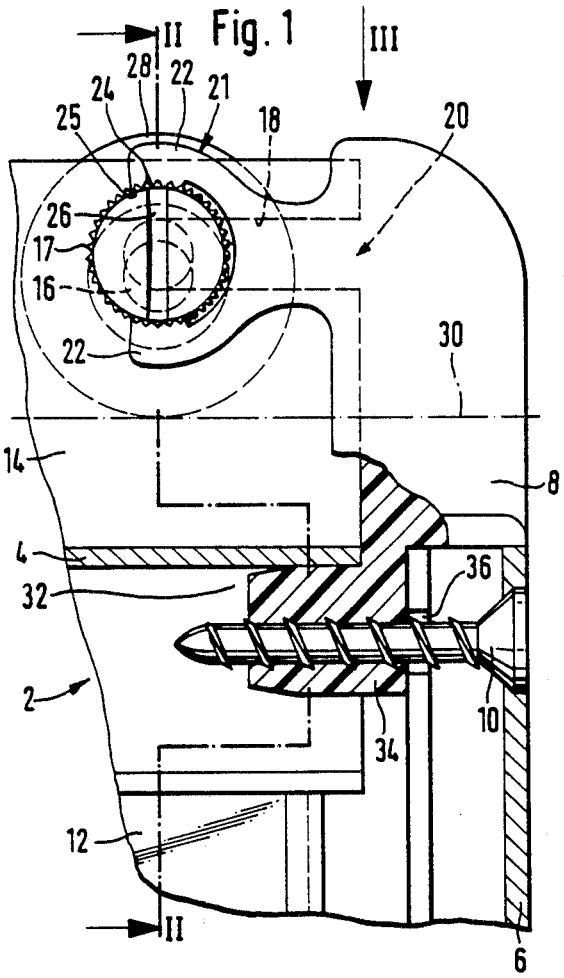
FIG. 1 shows one top corner of a door assembly partly in elevation and partly in cross-section.

The top profiled rail 4 comprises a guide member 14 at the top of which a solid eccentric pin 16 member is mounted. To this end, the guide member 14 contains an elongated slot 18 arranged substantially horizontally and having an end opening 20. During assembly, the central part of the eccentric pin 16 is inserted into the elongated slot 18 through the end opening 20. The connecting part 8 has resiliently holding means 21 engaging a peripheral surface 17 of an outer part of eccentric pin member 16. Holding means 21 have two arms 22 with locking means to prevent rotation of the pin 16, being referred to hereinafter as locking arms 22 comprising radially inward, diametrically opposed bearing surfaces 25 shown here in the form of teeth 24. The bearing surface teeth 24, and the engagement surface teeth 17 in association therewith, are designed in such a manner as to provide a clamping connection. This exerts a retaining force such that inadvertent rotation of eccentric pin 16 cannot occur. In the case of this clamping connection, the retaining force may be obtained by positive and/or frictional connection between the surfaces 17 and 25 in contact with each other. The locking arms 22 engage, through the teeth 24 and with a predetermined prestress, in teeth 17 of the eccentric pin 16. The teeth 17 are coaxial with the axis of rotation of the eccentric pin 16 and with the transverse axis of elongated slot 18. The outer part of the eccentric pin 16 comprises a slot 26 into which a coin or a screwdriver may be inserted for the purpose of rotating it. The height of a guide roller 28, arranged upon a stub shaft of the eccentric pin 16, alters according to the rotational position. The guide roller 28 runs, in known fashion, upon the track of a guide rail 30 shown in FIG. 1 by a broken line only. Arms 22 are curved and act substantially at right angles to the elongated slot 18. Because of arms 22 of the connector member 8 and the resilient force, the pin 16 cannot be forced out of the elongated slot 18.

Top profiled rail 4 is formed with a longitudinal channel 32 in which a pin 34 of the connecting part 8 engages. Attachment element or screw 10 is inserted through a transverse passage 36 in the side profiled rail 6 and engages, with its thread, at least partly in pin 34.

Figure 2:
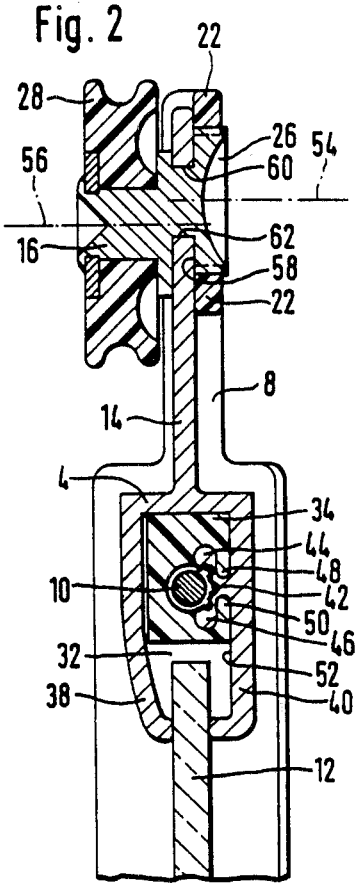
FIG. 2 is a cross-section along line II—II in FIG. 1.

The cross-section in FIG. 2 shows quite clearly the longitudinal channel 32, in the profiled rail 4, in which the pin 34 of the connecting part 8 engages. Profiled rail 4 is in the form of a clamping rail for the sheet 12 which is secured between arms 38, 40. A web 42, with two lateral projections 44, 46, are provided within the longitudinal channel 32, a threaded channel for the attachment element or screw 10 being formed between the projections 44, 46 and the pin 34. The latter comprises support elements 48, 50 that engage behind the projections 44, 46. In other words, the projections 44, 46 are held, by the support elements 48, 50, upon inner lateral wall 52 of the profiled rail 4. Undue bending, or breaking off, of the projections 44, 46 upon introduction of the screw 10 is prevented in a surprisingly simple manner. On the other hand, production of the threaded channel for the attachment element or screw 10 is extremely simple and relatively simple tools, more particularly pressing tools, are needed to produce the profiled rail 4. Because of their simple shape, such pressing tools have a long life. Narrow cavities, which could become blocked during flushing with acid, are avoided, whereby the durability of the profiled rail is not inconsiderably improved.

The shape of the eccentric pin member 16 is shown clearly in FIG. 2, its circular central and outer parts being rotatable about a common axis 54 in the previously mentioned elongated slot 18. When a tool or a coin is inserted into the slot 26, the locking arms 22 yield resiliently, setting the eccentric pin 16 free to rotate. On the other side of the guide member 14, the eccentric pin 16 has a stub shaft which rotatably carries guide roller 28 by means of which the door assembly is suspended in an appropriate guide rail. Axis 56 of the rotary guide roller 28 is arranged eccentrically in relation to the common axis 54, so that when the eccentric pin member 16 is rotated about its axis of rotation 54, the height of the guide roller 28, and thus that of the door assembly, is adjusted. Eccentric pin 16 comprises a central peripheral groove 58, the diameter of which matches the transverse width of the elongated slot 18. Axial localization of the eccentric pin 16 is easily achieved. Substantially horizontal side walls 60, 62 of the elongated slot 18 engage in the annular groove 58 substantially without play. The suspension of guide member 14, and thus of the door assembly 2 as a whole, is effected by the upper wall 60.

Figure 3:
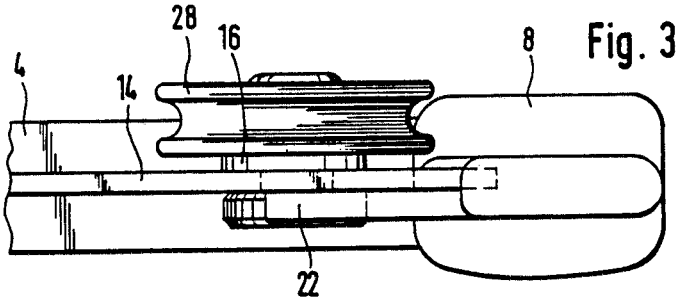
FIG. 3 is a top view in the direction according to arrow III in FIG. 1.

FIG. 3 is a top view of the corner of the door assembly shown in FIG. 1. Here again, the overall size of connector member 8 is seen quite clearly. As may be seen in conjunction with FIG. 2, connector member 8 has a comparatively narrow upper part with locking arms 22, and a comparatively wide lower part which covers the entire width of the profiled rail. Guide roller 28 is arranged in the elongated slot in guide member 14 of top profiled rail 4.

I claim:

1. A shower partition having a horizontal guide rail and at least one door assembly mounted for displacement along said guide rail, said door assembly comprising:

a top frame member, side frame members and connector members joining said side frame members to said top frame member; said top frame member being formed with an upwardly projecting guide member having a horizontal open-ended slot at each end thereof;

a pair of solid eccentric pin members, each pin member comprising:

a circular rotary central part slid inside one of said slots through the open end thereof;

a circular outer part coaxial with and having a larger diameter than said central part and projecting outwardly on one side of said guide member, and an inner part having a diameter larger than said central part and carrying a cylindrical stub shaft having an axis eccentric with respect to the common axis of said coaxial central and outer parts and projecting outwardly on the other side of said guide member;

arm means on said connector members on said one side of said guide member; said arm means resiliently engaging and releasably holding said circular outer parts, and thus said eccentric pin members, against rotation;

a pair of guide rollers mounted on said guide rail for allowing displacement therealong of said door assembly, and means mounting said rollers each on one of said eccentric stub shafts on said other side of said guide member for rotation about said eccentric axes.

2. A shower partition as claimed in claim 1, wherein said central parts of said eccentric pin members are each formed with a peripheral groove slidably receiving the opposed edges of the associated slot.

3. A shower partition as claimed in claim 1, wherein said arm means on each of said connector members comprise a pair of arms resiliently pressing on diametrically opposite points on the periphery of an associated one of said circular outer parts of said eccentric pin members.

4. A shower partition as claimed in claim 1, wherein said circular outer parts of said eccentric pins are formed with teeth along the periphery thereof and said arm means comprise pairs of arms on said connector members having teeth resiliently engaging with said teeth of said circular outer parts on diametrically opposite points of said outer parts.

5. A shower partition as claimed in claim 3, wherein said diametrically opposite points are on lines normal to the longitudinal direction of said slots.

6. A shower partition as claimed in claim 4, wherein said diametrically opposite points are on lines normal to the longitudinal direction of said slots.

7. A shower partition as claimed in claim 1, further comprising means releasably interconnecting said top frame member, said side frame members and said connector members together.

8. A shower partition having a horizontal guide rail and at least one door assembly mounted for displacement along said guide rail, said door assembly comprising:

a top frame member, side frame members, connector members joining said side frame members to said top frame member and means releasably connecting said top frame member, side frame members and connecting members together; said top frame member being formed with an upwardly projecting guide member having a horizontal open-ended slot at each end thereof;

a pair of solid eccentric pin members disposed in said horizontal slots, each pin member comprising a circular rotary central part, a circular outer part coaxial with said central part and projecting outwardly on one side of said guide member, and a cylindrical stub shaft having an axis eccentric with respect to the common axis of the coaxial central and outer parts and projecting outwardly on the other side of said guide member;

means on said connector members resiliently engaging said circular outer parts and releasably holding said eccentric pin members against rotation;

a pair of guide rollers mounted on said guide rail for allowing displacement therealong of said door assembly, and means mounting each of said rollers on one of said eccentric stub shafts for rotation about said eccentric axes;

wherein said releasably interconnecting means are screws, and wherein said top frame member is a profile member formed with a longitudinal open-ended channel having, at each open end thereof, an inwardly extending web formed with projections laterally extending from the inward end of said web, and further comprising pins on said connector members engaged into said longitudinal channels through said open ends and forming, with said web and web projections, threaded channels for said screws, said screws being driven across said side members and into said threaded channels.

9. A shower partition as claimed in claim 8, wherein said pins of said connector members engage between said lateral projections of said webs and the inner wall of said longitudinal channel.

10. A shower partition as claimed in claim 9, wherein said side members are formed of transverse passages for the driving through of said screws.

11. A shower partition as claimed in claim 1, wherein said connector members are arranged substantially above the side frame members and are generally aligned with the end faces of the top frame member.

12. A shower partition as claimed in claim 1, wherein said arm means are integral with said connector members.

13. A shower partition as claimed in claim 1, wherein each said horizontal slot is an elongated slot, and the diameter of the central part of each said eccentric pin member corresponds to the width of the slot in which it is disposed.

14. A shower partition as claimed in claim 1, wherein said connector members hold said eccentric pin members in said open-ended slots.

15. A shower partition having a horizontal guide rail and at least one door assembly mounted for displacement along said guide rail, wherein said door element is mounted on said guide rail by means of a plurality of eccentric pin members each of which is arranged in an elongated horizontal open-ended slot adjacent the top of the door element; wherein a connecting element joining a top frame member to a side frame member of said door assembly is provided having an integral arm portion which resiliently engages a contact surface on one of said eccentric pin members to prevent rotation of the pin member, and wherein said connecting element holds said eccentric pin member from sliding out the open end of said horizontal elongated slot.

* * * * *